US009914466B1

(12) United States Patent
Donnan

(10) Patent No.: US 9,914,466 B1
(45) Date of Patent: Mar. 13, 2018

(54) REVERSER HANDLE AND METHOD OF USE

(71) Applicant: Railhead Corporation, Alsip, IL (US)

(72) Inventor: Joseph Donnan, Oak Lawn, IL (US)

(73) Assignee: Railhead Corporation, Alsip, IL (US)

( * ) Notice: Subject to any disclaimer, the term of this patent is extended or adjusted under 35 U.S.C. 154(b) by 0 days.

(21) Appl. No.: 15/279,996

(22) Filed: Sep. 29, 2016

Related U.S. Application Data

(63) Continuation-in-part of application No. 13/733,303, filed on Jan. 3, 2013, now Pat. No. 9,487,220.

(60) Provisional application No. 61/582,899, filed on Jan. 4, 2012.

(51) Int. Cl.

| | |
|---|---|
| ***B61L 15/00*** | (2006.01) |
| ***B61C 17/12*** | (2006.01) |
| *F21V 5/04* | (2006.01) |
| *F21Y 115/10* | (2016.01) |
| *F21S 9/02* | (2006.01) |

(52) U.S. Cl.
CPC ..... *B61L 15/009* (2013.01); *B61C 17/12* (2013.01); *F21S 9/02* (2013.01); *F21V 5/04* (2013.01); *F21Y 2115/10* (2016.08)

(58) Field of Classification Search
CPC .... B61L 15/009; B61C 17/12; F21Y 2115/10; F21S 9/02; F21V 5/04
See application file for complete search history.

(56) References Cited

U.S. PATENT DOCUMENTS

| | | | | |
|---|---|---|---|---|
| 1,705,059 | A | 3/1929 | Sauman | |
| 4,637,668 | A | 1/1987 | Kleffman et al. | |
| 5,542,891 | A | 8/1996 | Kettle, Jr. et al. | |
| 5,552,761 | A | 9/1996 | Kazyaka | |
| 5,909,952 | A * | 6/1999 | Guthrie | F21L 2/00 362/184 |
| 6,930,594 | B1 | 8/2005 | Wang | |
| 8,740,156 | B1 * | 6/2014 | Samora | B61L 15/009 105/26.05 |

* cited by examiner

*Primary Examiner* — Thomas C Diaz
(74) *Attorney, Agent, or Firm* — Doherty, Wallace, Pillsbury & Murphy, P.C.

(57) ABSTRACT

A reverser handle comprising a key component integrally associated with a light component. In an exemplary embodiment, the light component comprises a cap which houses a light source, such as, e.g., a plurality of light emitting diodes, a light bulb, or a photoluminescent material which allows the cap to glow in the dark. The key component comprises a body having extending therefrom a flange which is configured to actuate a control stand. The light component preferably comprises a blue light emitting light source to comply with a blue flag safety procedure.

13 Claims, 10 Drawing Sheets

REVERSER HANDLE AND METHOD OF USE

BACKGROUND OF THE INVENTION

1. Field of the Invention

The present disclosure relates generally to reverser handles, and, more particularly, to a reverser handle that emits light and to a method of use.

2. Background of the Invention

A reverser handle, which is commonly referred to as a "railroad key," is an operating control for a railroad locomotive that is used to determine the direction of travel. The reverser usually has three positions: forward, reverse, and neutral. When the reverser is in the forward or reverse position, the locomotive will move in the indicated direction when the throttle is opened. Removing the reverser handle from the control stand in the neutral position locks the throttle controller, effectively disabling the locomotive. Oftentimes reverser handles are handled in dimly lit environments, making it difficult to see precisely where the reverser handle fits within the control stand. Accordingly, it would be useful to have a reverser handle integrated with a light emitting member thereby enhancing an operator's visibility so that the operator can accurately position the reverser handle in the locomotive's control stand.

The present invention is designed to overcome another problem frequently encountered in the railroad industry. A safety concern on railroads is injury caused when an engineer puts a locomotive into motion without knowing there are others nearby who are inspecting or repairing the locomotive. Railroad companies have implemented a safety procedure to prevent such an occurrence which is referred to as the "Blue Flag" procedure. Under the Blue Flag procedure, an operator working on a locomotive is required to place a blue flag in the locomotive's cab. No one is permitted to move any locomotive tagged in this manner. Unfortunately, this does not always protect against poorly trained or careless operators, or just plain human error. Accordingly, what is needed is a key that can integrate the blue flag safety requirement.

BRIEF SUMMARY OF THE INVENTION

The above described deficiencies of the prior art are cured or alleviated by a reverser handle that is integrated with a light emitting component. In a first exemplary embodiment, the reverser handle comprises a key component integrally associated with a light component. The light component comprises a cap that houses a light source. An exemplary light source includes, e.g., light emitting diodes, a light bulb, a photoluminescent material, and the like. In an exemplary embodiment, the light source emits a blue light so that the reverser handle may be used to warn operators that the control stand is not to be actuated which would cause the locomotive to more either in a forward or a rearward direction depending on the position of the reverser handle in the control stand. The reverser handle, thereby, serves as an improved, effective, and reliable locomotive safety device for enforcing the blue flag safety procedure by warning operators that the locomotive is classified in the "blue flag" condition and should not be moved.

These and other features and advantages of the present invention will be more fully understood from a reading of the following detailed description with reference to the accompanying drawings.

DETAILED DESCRIPTION OF THE INVENTION

The reverser handle of the present invention comprises a key component and a light component, wherein, in an exemplary embodiment, the key component is integrally formed with the light component. The key component is configured to fit within a control stand of a locomotive, and to cause the locomotive to stay neutral, i.e., non-moving, to move in reverse direction, or to move in a forward direction. The light component comprises a light source assembly and a sleeve. The light source assembly includes a light source, such as, e.g., a light bulb, a light emitting diode, a photoluminescent, and the like, wherein in an especially preferred embodiment, the light source emits a blue colored light so that the reverser handle can be used according to the Blue Light safety procedure. In an exemplary embodiment, the sleeve holds a battery source which is in electrical communication with the light source assembly.

Figure 1:
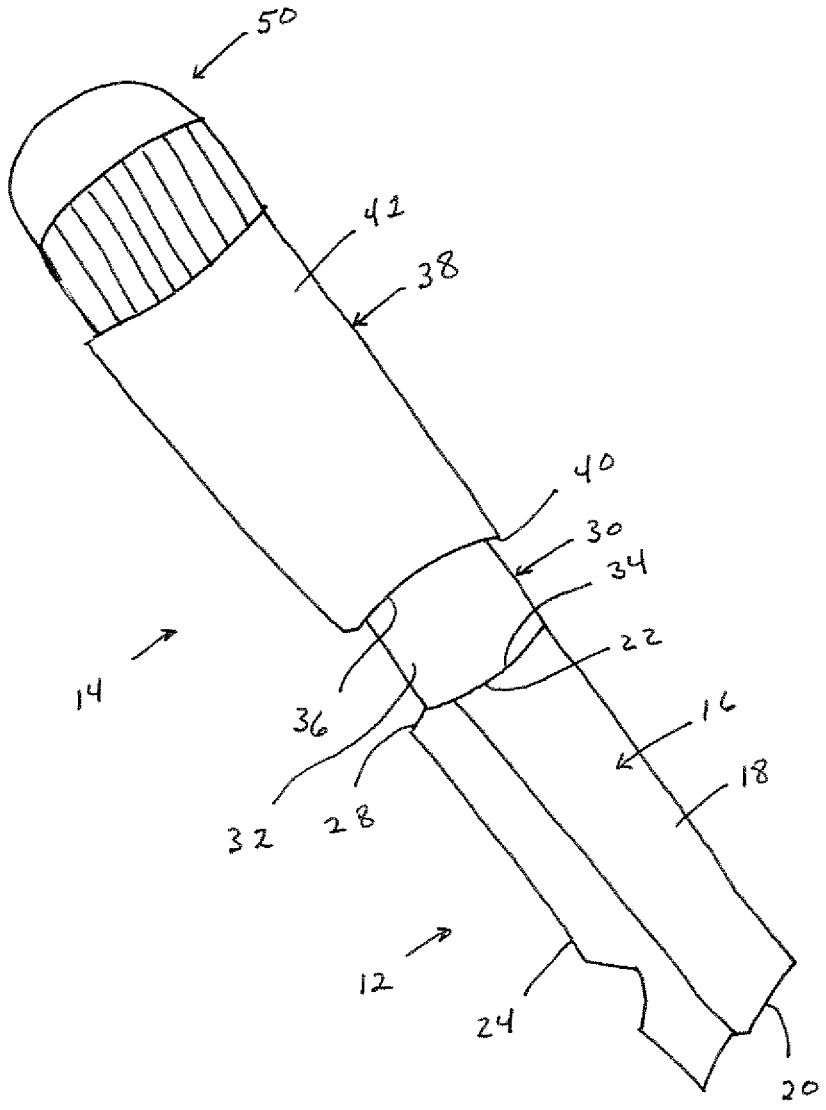
FIG. 1 is a photograph depicting a side view of an exemplary reverser handle.
Figure 2:
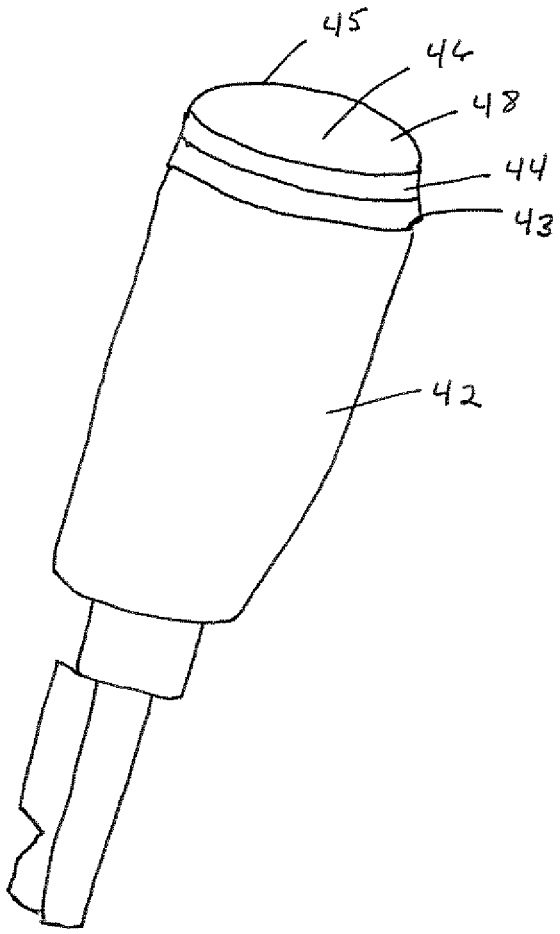
FIG. 2 is a photograph depicting a side view of the reverser handle depicted in FIG. 1 shown without a cap.
Figure 3:
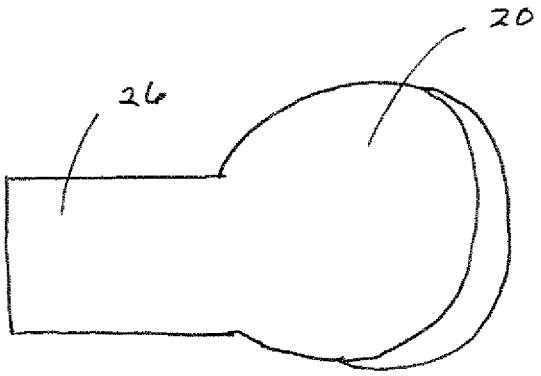
FIG. 3 is a photograph depicting an anterior end of the reverser handle depicted in FIG. 1.

Referring to FIG. 1, an exemplary reverser handle 10 comprises a key component 12 integrally associated with a light component 14. Key component 12 comprises a body 16, wherein body 16 has a longitudinally extending side wall 18 perpendicularly formed with a forward directed wall 20 on a terminal end thereof and with a rearward directed wall 22 on an oppositely situated terminal end thereof. A notched flange 24 perpendicularly extends from and is integrally formed with side wall 18. Notched flange 24 further has an end 26 that is coterminous with forward directed wall 20 and an end 28 that is coterminous with rearward directed wall 22. Notched flange 18 is configured to be received by a locomotive's control stand and serves to actuate the control stand, i.e., to move the locomotive into either the forward or the reverse direction, wherein an exemplary control stand is conventionally known.

Key component 12 further comprises a collar 30 having a generally cylindrical shaped side wall 32 flanked on a terminal end thereof by a forward directed wall 34 and on an oppositely terminal end thereof by a rearward directed wall 36. Forward directed wall 34 of collar 30 is centrally and integrally formed with rearward directed wall 22 of body 16 such that notched flange 24 extends past body 32 of collar 30.

Light component 14 comprises a sleeve 38, a light source assembly 50, and a battery cartridge 70. Sleeve 38 comprises a forward directed wall 40 that is centrally formed with and integrally attached to rearward directed wall 36 of collar 30. A generally cylindrically shaped side wall 42 of sleeve 38 perpendicularly and linearly extends from forward directed wall 40 where it terminates at a forward directed end 43. Forward directed end 43 tapers inwardly to form a threaded neck region 44. A chamber 46 is surrounded by side wall 42 and is continuously formed with and extends from forward directed wall 40 and from an opening 48 formed at a terminal end 45 of neck region 44.

Figure 4:
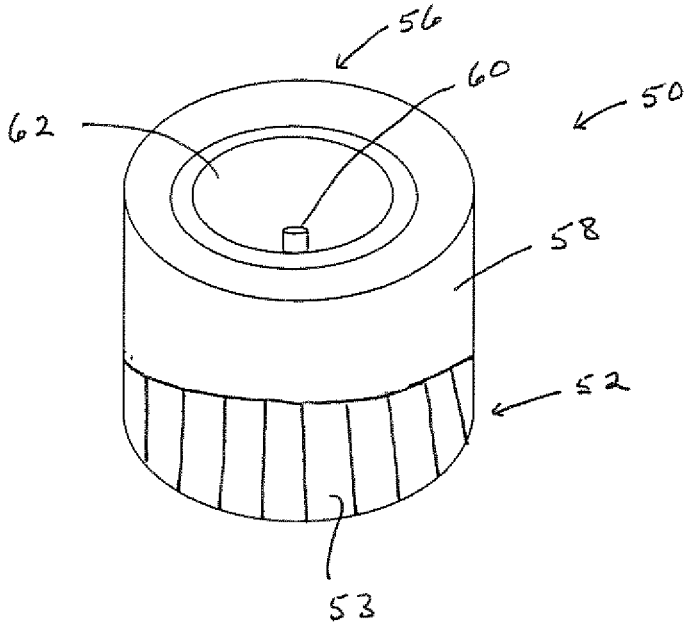
FIG. 4 is a photograph depicting a top side of an exemplary light source assembly.
Figure 5:
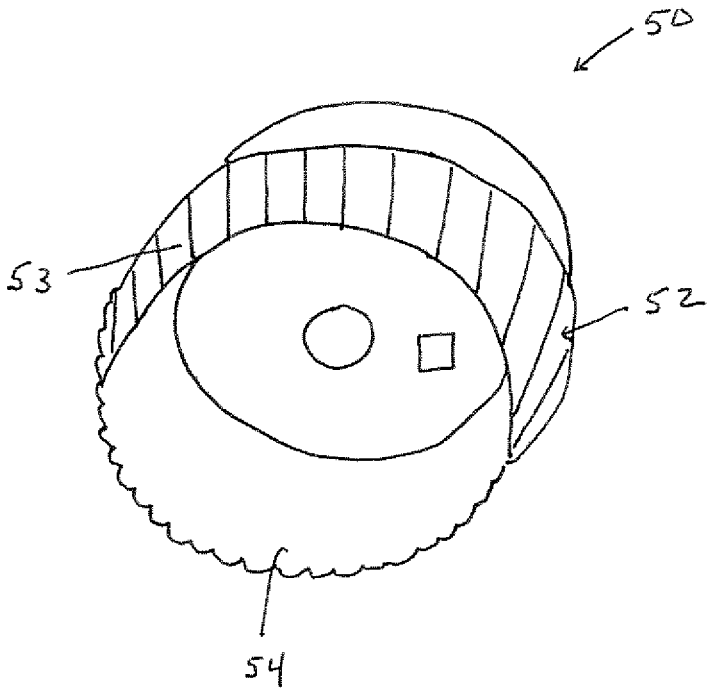
FIG. 5 is a photograph depicting a bottom side of the light source assembly depicted in FIG. 4.

As best shown in FIGS. 4 and 5, light source assembly 50 comprises a cap 52. Cap 52 comprises a generally annular shaped body 53. An interior side 54 of body 53 is threaded, wherein the threads of interior side 54 engage with threaded neck region 44 of sleeve 38 to thereby secure cap 52 to sleeve 38.

Light source assembly 50 further comprises a light emitting diode subassembly 56, wherein light emitting diode subassembly 56 comprises a lens cap 58, a light emitting diode 60, and a reflective dome 62. Lens cap 58 is rotatably secured onto body 53 of cap 52 and the remainder of light source assembly 50 is disposed between lens cap 58 and cap 52.

Figure 6:
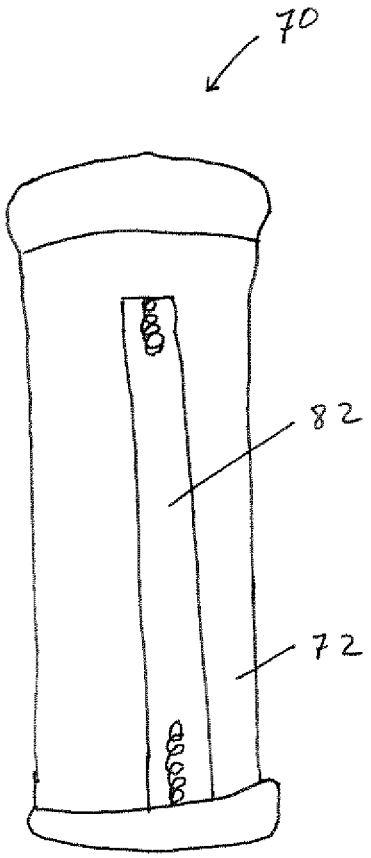
FIGS. 6-8 are photographs depicting an exemplary battery cartridge of the reverser handle depicted in FIG. 1.
Figure 7:
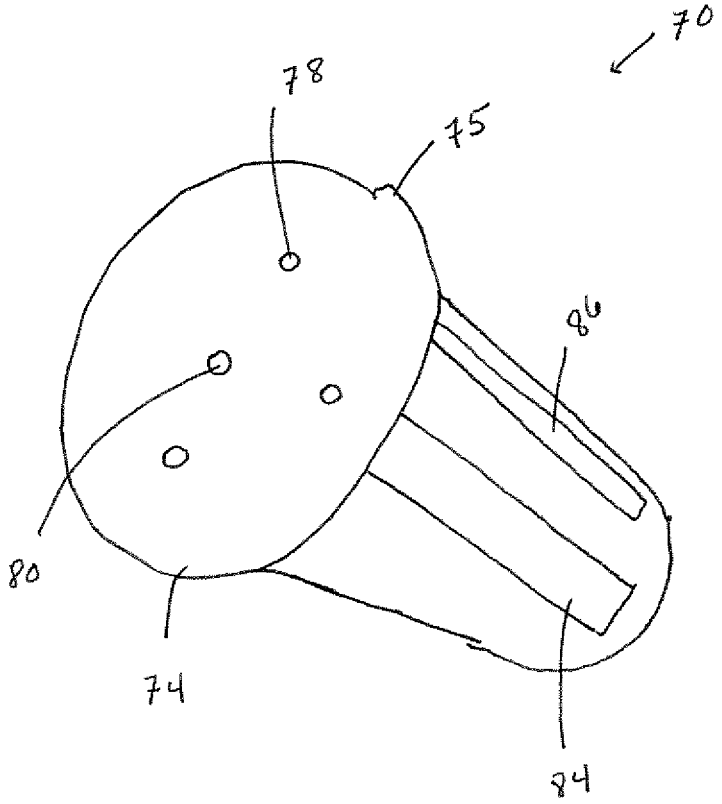
Figure 8:
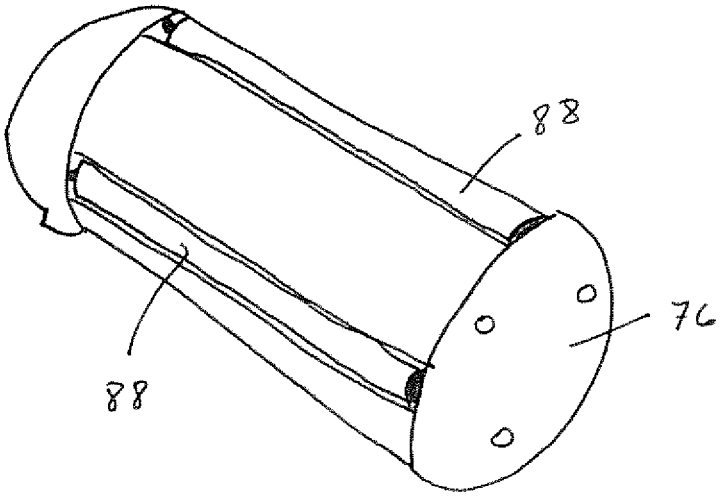
Figure 9:
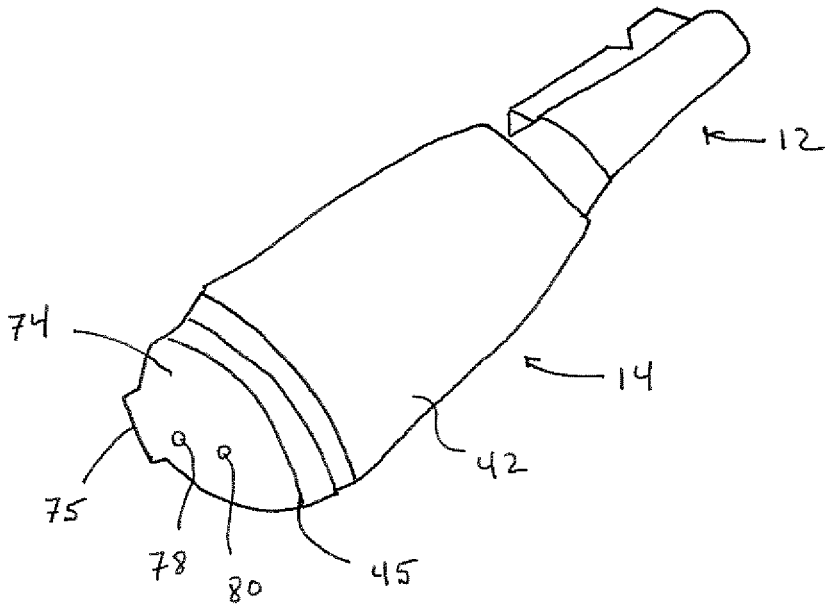
FIG. 9 is a photograph depicting the reverser handle depicted in FIG. 1 without the light source assembly.

Reverser handle 10 further comprises a battery cartridge 70 as depicted in FIGS. 6-8. Battery cartridge 70 includes a top side 74 oppositely situated to a bottom side 76, wherein top and bottom sides 74 and 76 are joined to one another by a generally cylindrical shaped housing 72. Top side 74 includes a contact member 78 and an anode contact member 80. Top side 74 further includes a tab 75 that extends from an outer perimeter of top side 74, wherein tab 75 is adjacently positioned to cathode contact member 78. Housing 72 comprises a series of slots 82 formed therethrough, wherein each slot from series 82 longitudinally extends from top and bottom sides 74 and 76 and leads into an interior chamber 84. An electrically conductive metal strip 86 is disposed on housing 72 such that strip 86 is in electrical communication with cathode contact member 78. An alkaline battery 88 is insertable within each slot from series 82 and is contained within interior chamber 84.

Battery cartridge 70 is disposed within chamber 46 such that top side 74 is disposed towards light source assembly 50, and is in electrical communication with light emitting diode 60 when threaded interior side 54 of body 53 is engaged with threaded neck region 44. Top side 74 physically abuts terminal end 45 of side wall 42 of sleeve 38.

Light emitting diode 60 may be actuated, i.e., turned on, by rotating lens cap 58 relative to cap 52 in, e.g., a clockwise direction, and may be de-actuated, turned off, by rotating lens cap 58 relative to cap 52 in, e.g., a counterclockwise direction.

In an exemplary embodiment, reverser handle 10 comprises a light emitting diode 60 that emits a blue-colored light to satisfy the blue flag safety procedure.

Figure 10:
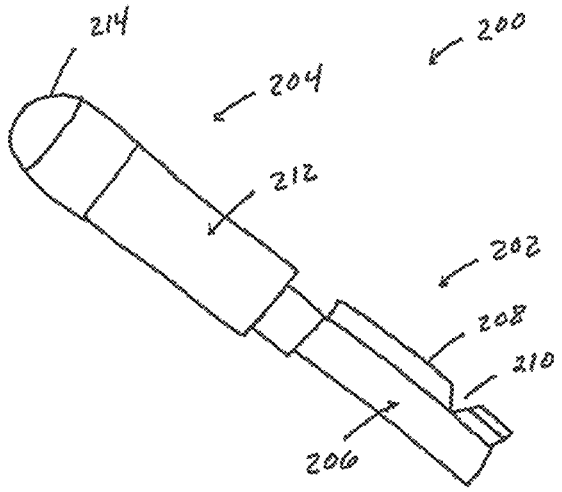
FIG. 10 is a schematic depicting another exemplary reverser handle.

Referring to FIG. 10, in another exemplary embodiment, a reverser handle 200 comprises a key component 202 integrally associated with a light component 204. Key component 202 comprises a longitudinally extending body 206 from which a flange 208 axially extends. Flange 208 has a notch 210 formed therein which is configured to be received by a locomotive's control stand and which actuates the control stand. Light component 204 comprises a longitudinally extending member 212 which is integrally engaged with body 206. Light component 204 further comprises a cap 214 disposed atop longitudinally extending member 212. Cap 214 contains a photoluminescent material that glows in the dark. In an exemplary embodiment, the photoluminescent material comprises a phosphorescent, which may comprise, for example, zinc sulfide, strontium aluminate, and the like. Alternatively, the photoluminescent material may comprise a radioactive isotope combined with a phosphor, wherein the radioactive isotope may include, for example, radium, tritium, promethium, and the like.

Therefore, reverser handle 200 provides a means whereby the reverser handle can provide a light source to ease visibility in dimly lit and/or dark environments. However, unlike reverser handle 10, reverser handle 200 does not require an electrical power source.

While the disclosure has been shown and described with reference to certain preferred embodiments thereof, it will be understood by those skilled in the art that various changes in form and detail may be made therein without departing from the spirit and scope of the disclosure.

What is claimed is:

1. A reverser handle comprising:

a key component comprising:

a longitudinally extending body; and a flange axially disposed on the longitudinally extending body, wherein the flange is configured to be received within a control stand of the locomotive, and wherein the flange is further configured to actuate the control stand such that the locomotive moves in either a forward direction or a reverse direction depending on the position of the key component relative to the control stand; and a light component attached to the longitudinally extending body, wherein the light component comprises:

a sleeve having a longitudinally extending body which is integrally formed with the key component; and a light source assembly comprising:

a cap;

a light source; and a lens cap;

wherein the light source is disposed between the cap and the lens cap, and wherein the cap is engaged with the sleeve to thereby secure the light source assembly to the sleeve, and further wherein the lens cap is rotatably secured to the cap, such that when the lens cap is rotated in a direction relative to the cap, the light source is turned on, and when the lens cap is rotated in an opposite direction relative to the cap, the light source is turned off.

2. The reverser handle of claim 1, wherein the sleeve has a chamber formed therethrough, and wherein the reverser handle further comprises a power source, wherein the power source is disposed within the chamber, and further wherein the power source is in electrical communication with the light source.

3. The reverser handle of claim 2, wherein the power source comprises a cartridge and a battery source, wherein the cartridge comprises:

a longitudinally extending housing having a series of slots longitudinally formed therethrough;

a top side perpendicularly arranged relative to the housing, wherein the housing is recessed relative to the top side, and further wherein an anode contact member and a cathode contact member protrude through the top side; and a bottom side perpendicularly arranged relative to the housing and positioned on a side of the housing opposite to the top side; and the battery source comprises a series of batteries, wherein the series of batteries is disposed within the series of slots, and further wherein the light source is in electrical communication with the anode contact member and the cathode contact member.

4. The reverser handle of claim 3, wherein the sleeve has a threaded portion which is engaged with a threaded portion of the cap to thereby secure the light source to the sleeve.

5. The reverser handle of claim 4, wherein the top side of the cartridge physically abuts the threaded portion of the sleeve.

6. The reverser handle of claim 5, wherein the light source comprises a light emitting diode.

7. The reverser handle of claim 6, wherein the light emitting diode emits a blue light.

8. A method of warning an operator that a locomotive is being serviced or inspected, comprising:

providing a reverser handle, wherein the reverser handle comprises:

a key component, comprising:

a longitudinally extending body; and a flange axially disposed on the longitudinally extending body, wherein the flange is configured to be received within a locomotive's control stand; and a light component physically attached to the key component, wherein the light component comprises:

a sleeve comprising a longitudinally extending side wall flanked on a terminal end thereof by a forward directed wall and flanked on an oppositely situated terminal end thereof by a rearward directed wall, wherein the rearward directed wall is integrally formed with the key component; and a light source assembly comprising a cap which is removably engaged with the sleeve, and a lens cap which is rotatably connected to the cap;

inserting the flange of the key component into a key hole of a control stand of the locomotive; and actuating the light source assembly such that the light source assembly emits a light, wherein actuating the light source assembly comprises rotating the lens cap relative to the cap.

9. The method of claim 8, wherein the forward directed wall of the sleeve tapers inwardly to form a threaded neck region, and wherein the cap of the light source assembly has a threaded interior portion, wherein the threaded interior portion is threadably engaged with the threaded neck region to thereby secure the sleeve to the light source assembly.

10. The method of claim 8, further comprising a power source in electrical communication with the light source assembly, wherein the power source is disposed within a chamber centrally formed within the side wall of the sleeve.

11. The method of claim 10, wherein the power source comprises a cartridge and a battery source, wherein the cartridge comprises:

a longitudinally extending housing having a series of slots longitudinally formed therethrough;

a top side perpendicularly arranged relative to the housing, wherein the housing is recessed relative to the top side, and further wherein an anode contact member and a cathode contact member protrude through the top side; and a bottom side perpendicularly arranged relative to the housing and positioned on a side of the housing opposite to the top side; and the battery source comprises a series of batteries, wherein the series of batteries is disposed within the series of slots, and further wherein the light source assembly is in electrical communication with the battery source via the anode contact member and the cathode contact member.

12. The method of claim 11, wherein the light source assembly further comprises a light emitting diode subassembly disposed between the lens cap and the cap, wherein the light emitting diode subassembly is in electrical communication with the battery source via the anode contact member and the cathode contact member.

13. The method of claim 12, wherein the light emitting diode subassembly comprises a light emitting diode that emits a blue light when the light source assembly is actuated.

* * * * *